US007707981B2

(12) United States Patent
Boese et al.

(10) Patent No.: US 7,707,981 B2
(45) Date of Patent: May 4, 2010

(54) DEVICE FOR THE VARIABLE ADJUSTMENT OF THE CONTROL TIMES FOR GAS EXCHANGE VALVES IN AN INTERNAL COMBUSTION ENGINE

(75) Inventors: Olaf Boese, Nuremberg (DE); Gerhard Scheidig, Nuremberg (DE); Andreas Strauss, Forchheim (DE); Rainer Ottersbach, Aurachtal (DE)

(73) Assignee: Schaeffler KG, Herzogenaurach (DE)

( * ) Notice: Subject to any disclaimer, the term of this patent is extended or adjusted under 35 U.S.C. 154(b) by 227 days.

(21) Appl. No.: 11/913,953

(22) PCT Filed: May 12, 2006

(86) PCT No.: PCT/EP2006/004479

§ 371 (c)(1),
(2), (4) Date: Nov. 9, 2007

(87) PCT Pub. No.: WO2006/125536

PCT Pub. Date: Nov. 30, 2006

(65) Prior Publication Data

US 2008/0184948 A1 Aug. 7, 2008

(30) Foreign Application Priority Data

May 23, 2005 (DE) ..... 10 2005 024 241

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 6,418,893 | B1 | 7/2002 | Auchter et al. | |
| 6,418,897 | B1 * | 7/2002 | Urban et al. | 123/90.17 |
| 6,487,996 | B1 * | 12/2002 | Motz et al. | 123/90.17 |
| 2002/0020375 | A1 * | 2/2002 | Sluka et al. | 123/90.15 |
| 2002/0035981 | A1 | 3/2002 | Kobayashi | |

FOREIGN PATENT DOCUMENTS

| | | |
|---|---|---|
| DE | 19908934 | 9/2000 |
| DE | 19951391 | 7/2001 |
| DE | 10212606 | 10/2002 |
| DE | 102004026863 | 8/2005 |
| EP | 0801212 | 7/2000 |
| EP | 1544419 | 6/2005 |
| EP | 1544420 | 6/2005 |

* cited by examiner

*Primary Examiner*—Zelalem Eshete
(74) *Attorney, Agent, or Firm*—Volpe and Koenig, P.C.

(57) ABSTRACT

A device (1) for the variable adjustment of control times of an internal combustion engine, including a stator (2), a driven element (3) arranged coaxially thereto, with both components being assembled so as to rotate relative to one another, and both components define at least one pressure chamber (10) at least in the radial and circumferential directions, and a housing (11), separate from the stator (2) and the driven element (3) which encloses the stator (2) and the driven element (3) in an oil-tight manner, whereby the housing (11) seals and defines the pressure chamber in an axial direction.

19 Claims, 3 Drawing Sheets

DEVICE FOR THE VARIABLE ADJUSTMENT OF THE CONTROL TIMES FOR GAS EXCHANGE VALVES IN AN INTERNAL COMBUSTION ENGINE

BACKGROUND

The invention relates to a device for the variable adjustment of the control times for gas-exchange valves of an internal combustion engine according to the preambles of claims 1 or 5.

In internal combustion engines, camshafts are used for actuating the gas-exchange valves. Camshafts are mounted in the internal combustion engine such that cams mounted on the camshafts contact cam followers, for example, cup tappets, finger levers, or rocker arms. If a camshaft is set in rotation, then the cams roll against the cam followers, which, in turn, actuate the gas-exchange valves. Through the position and the shape of the cams, both the opening period and also the opening amplitude, but also the opening and closing times of the gas-exchange valves are set.

Modern engine concepts are moving towards a design with a variable valve drive. On one hand, the valve stroke and valve opening period should be able to be shaped variably up to the complete shutdown of an individual cylinder. For this purpose, concepts, such as switchable cam followers or electro-hydraulic or electrical valve actuators are provided. Furthermore, it has been shown to be advantageous to influence the opening and closing times of the gas-exchange valves during the operation of the internal combustion engine. Here, it is especially desirable to influence the opening or closing times of the intake or exhaust valves separately, in order to selectively set, for example, a defined valve overlap. By adjusting the opening or closing times of the gas-exchange valves as a function of the current engine-map range, for example, the current rotational speed or the current load, the specific fuel consumption can be reduced, the exhaust-gas behavior can be positively influenced, and the engine efficiency, the maximum torque, and the maximum output can be increased.

The described variability of the valve control times is achieved through a relative change in the phase position of the camshaft relative to the crankshaft. Here, the camshaft is usually in driven connection with the crankshaft via a chain, belt, or gear drive or a driving concept with an identical function. Between the chain, belt, or gear drive driven by the crankshaft and the camshaft there is a device for changing the control times of an internal combustion engine, also called camshaft adjuster below, which transfers the torque from the crankshaft to the camshaft. Here, this device is constructed so that during the operation of the internal combustion engine, the phase position between the crankshaft and the camshaft can be held securely and, if desired, the camshaft can be rotated within a certain angular range relative to the crankshaft.

Belt-driven camshaft adjusters are usually arranged outside of the cylinder head. Here, care must be taken that the camshaft adjuster must be completely sealed from the surroundings, in order to prevent the leakage of motor oil into the engine compartment. Any leakage oil must be captured and led back into the cylinder head.

In internal combustion engines with separate camshafts for the intake valves and the exhaust valves, these can each be equipped with a camshaft adjuster. Therefore, the opening and closing times of the intake and exhaust valves can be shifted in time relative to each other and the valve overlap can be adjusted selectively.

The position of modern camshaft adjusters is usually located on the driving-side end of the camshaft. The camshaft adjuster, however, can also be arranged on an intermediate shaft, a non-rotating component, or the crankshaft. It is made from a drive wheel, which is driven by the crankshaft and which keeps a fixed phase relationship relative to this crankshaft, a driven part in driving connection with the camshaft, and an adjustment mechanism transferring the torque from the drive wheel to the driven part. The drive wheel can be constructed, in the case of a camshaft adjuster not arranged on the crankshaft, as a chain, belt, or gear and is driven by the crankshaft by a chain, belt, or gear drive. The adjustment mechanism can be operated electrically (by a driving triple-shaft gear mechanism), hydraulically, or pneumatically.

A preferred embodiment of the hydraulic camshaft adjuster is the so-called rotary piston adjuster. In this embodiment, the drive wheel is locked in rotation with a stator. The stator and a driven element are arranged concentric to each other, wherein the driven element is connected non-positive, positive, or form fit, for example, by a press fit, a screw connection, or a weld connection, to the camshaft, an extension of the camshaft, or an intermediate shaft. In the stator, several hollow spaces spaced apart in the circumferential direction are formed, which extend radially outward from the driven element. The hollow spaces are defined in a pressure-tight way by side covers in the axial direction. Into each of these hollow spaces extends a blade, which is connected to the driven element and which divides each hollow space into two pressure chambers. Through selective connection of the individual pressure chambers to a pressurized medium pump or to a tank, the phase of the camshaft can be adjusted or held relative to the crankshaft.

For controlling the camshaft adjuster, sensors detect the characteristic data of the engine, such as, for example, the load state and the rotational speed. This data is fed to an electronic control unit, which controls the inflow and outflow of pressurized medium to and from the different pressure chambers after comparing the data with a characteristic data map of the internal combustion engine.

To adjust the phase position of the camshaft relative to the crankshaft, in hydraulic camshaft adjusters, one of the two pressure chambers of a hollow space acting against each other is connected to a pressurized medium pump and the other is connected to the tank. In this way, the pressurization of one chamber and the release of pressure in the other chamber displace the blade and thus directly cause a rotation of the camshaft relative to the crankshaft. To keep the phase position, both pressure chambers are either connected to the pressurized medium pump or both are separated from the pressurized medium pump and also the tank.

The pressurized medium flows to or from the pressure chambers are controlled by a control valve, usually a 4/3 proportional valve. Each valve housing is provided with a connection for the pressure chambers (working connection), a connection to the pressurized medium pump, and at least one connection to a tank. Within the essentially hollow cylindrical valve housing there is a control piston that can be shifted in the axial direction. The control piston can be brought into each position between two defined end positions in the axial direction via an electromagnetic actuator against the spring force of a spring element. The control piston is further provided with annular grooves and control edges, whereby the individual pressure chambers can be connected selectively to the pressurized medium pump or to the tank. Likewise, a position of the control piston can be provided, in which the pressure chambers are separated both from the pressurized medium pump and also from the pressurized medium tank.

Such a device is disclosed in DE 199 08 934 A1. This involves a device with a rotary piston construction. A stator is supported so that it can rotate on a driven element locked in rotation with a camshaft. The stator is constructed with recesses open to the driven element. In the axial direction of the device, compensating disks are provided, which define the recesses in the axial direction in a sealing manner. The recesses are closed in a pressure-tight manner by the stator, the driven element, and the compensating disks and thus form pressure spaces. On the outer casing surface of the driven element there are blades, which extend into the recesses. The blades are constructed so that they divide the pressure chambers into two pressure chambers acting against each other. By supplying or discharging pressurized medium to or from the pressure chambers, the phase position of the driven element can be selectively maintained or adjusted relative to the stator and thus the camshaft relative to the crankshaft. For this purpose, a device for the pressurized medium supply is provided with pressurized medium lines and a control valve.

The stator, the driven element, and the compensating disks are encapsulated by a two-part housing, which is locked in rotation with a drive wheel constructed as a toothed belt wheel.

The flat bases of the housing halves ensure a pressure-tight contact of the compensating disks on the stator and the driven element.

In addition, the driving torque of the crankshaft is transferred to the stator with a friction fit via the drive wheel and the bases of the compensating disks. Alternatively, it is proposed that the side surfaces of the stator have profiling, whereby an additional positive fit can be achieved.

In this embodiment, a large number of components are required for realizing the device, whereby increased assembly costs and thus production costs occur. In addition, the described transmission of the torque from the drive wheel to the stator is associated with increased production expense, which has a negative effect on the costs of the device.

SUMMARY

Therefore, the invention is based on the objective of avoiding these mentioned disadvantages and thus providing a device for the variable adjustment of the control times of gas-exchange valves of an internal combustion engine, in which the number of components and thus the assembly expense and the production costs of the device are reduced. Furthermore, the device shall be improved to the extent that the transfer of the torque from the crankshaft to the stator is improved and is achieved with more cost-effective measures.

In a first embodiment of a device for the variable adjustment of the control times of gas-exchange valves of an internal combustion engine with a stator, a driven element arranged coaxial thereto, wherein the two components are mounted so that they can rotate relative to each other and wherein the two components define at least one pressure space at least in the radial direction and in the circumferential direction, and with a housing, which is constructed separate from the stator and from the driven element and which at least partially encapsulates the stator and the driven element, the objective is met according to the invention in that the housing defines the pressure space in an axial direction in a sealing manner.

Here, it can be provided that the housing is made from at least two housing elements and at least one flat section of the housing projecting perpendicular to the axial direction of the device acts as a sealing surface for the pressure space and defines this space in an axial direction.

In one refinement of the invention, it is provided that the housing defines the pressure space in a sealing manner also in the other axial direction.

In addition, it can be provided that the stator is in driving connection with the housing via a positive-fit connection.

In another embodiment of a device for the variable adjustment of the control times of gas-exchange valves of an internal combustion engine with a driven element driving a camshaft, a stator driven by a crankshaft, wherein the two components are mounted so that they can rotate relative to each other, and with a housing, which is constructed separate from the stator and from the driven element and which at least partially encloses these components, wherein at least one pressure chamber is defined by the stator, the driven element, and the housing, the objective according to the invention is met in that a base of a pot-shaped section of the housing acts as a sealing surface for the pressure space at least in one axial direction.

In all of the embodiments, the stator can be constructed as a sheet-metal part that is shaped without cutting or as a solid sintered component.

In the case of the construction of the stator as a sheet-metal part shaped without cutting, this can be produced by a deep-drawing process.

It is also conceivable to construct at least one housing element as a sheet-metal part shaped without cutting, wherein this part can be produced by a deep-drawing process.

Such devices can be provided with a chain, a belt, or a gear and can be in drive connection with the crankshaft via a chain, a toothed belt, or a gear drive.

If the device is to be driven by means of a toothed belt, then the housing is constructed so that this prevents the discharge of pressurized medium from the device.

The two housing elements can be connected to each other by a weld connection, whereby the housing prevents the discharge of pressurized medium from the device.

In one advantageous refinement of the invention, it can be provided that a cylindrical section extending in the axial direction is constructed on the housing for sealing the device against a radial shaft sealing ring. In addition, it can be provided that a camshaft engages in the section and that a gap is constructed between the inner diameter of the section and the camshaft. Therefore, the device can be arranged outside of the cylinder head, wherein the section engages in an opening of the cylinder head and is sealed to this cylinder head by the radial shaft seal. Any leakage oil can be fed back via the gap between the section and the camshaft into the cylinder head and thus into the crankcase.

In another advantageous refinement of the invention, it is provided that molded elements are constructed on at least one of the housing elements for increasing the surface area. These molded elements are used, first, for reinforcing the housing and, second, for increasing its surface area, which leads to better cooling of the device. The molded elements can be constructed, for example, as cooling ribs.

By encapsulating the stator and the driven element by a housing, among other things, the following two tasks are fulfilled. First, the housing is used for closing the pressure spaces in the axial direction of the device in a pressure-tight manner. This can be realized either indirectly by pressing sealing disks against the stator or directly by the formation of sealing surfaces on the housing. In the case of toothed belt-driven devices, which are usually arranged outside of the cylinder head, the housing is also used as encapsulation for the device, which prevents the discharge of pressurized medium from the device into the engine compartment. Any leakage oil is captured within the housing and fed back into the engine compartment via an axial section. In this embodiment, the driven element is usually constructed as a sintered component, which must be sealed in a processing step following the shaping process. This processing step is usually very time-intensive and thus cost-intensive.

Through the formation of the housing as a sheet-metal part shaped without cutting, which is naturally oil-tight, such sealing processing steps can be eliminated. In addition, the number of connection points to be sealed can be reduced from at least two (between the side covers and the stator) to one (between the housing halves).

In comparison with the device described in the state of the art, a cost advantage can be achieved in that at least the function of one of the sealing disks is integrated into the housing. For this purpose, at least one base of a pot-shaped section of the housing has a flat construction. This base lies in a pressure-tight way in the axial direction both on the stator and also on the driven element.

The housing is made from two housing elements, in which the stator and the driven element can be placed. Here, both housing elements can have a pot-shaped construction. Also conceivable is an embodiment with a pot-shaped housing element and a flat housing element. The housing elements can be connected to each other by connection means, for example, screws or bolts, or a non-positive or positive fit. The base of at least one of the pot-shaped sections is flat and constructed so that it bounds the pressure spaces constructed between the stator and the driven element in an axial direction in a pressure-tight manner. It is also conceivable that the pressure spaces are defined in both axial directions by flat sections of the housing that are perpendicular to the axial direction of the device.

By reducing the number of components and the associated lower assembly expense, the costs of the device can be reduced considerably. Here, the cost-effective production of the housing elements has a positive effect through a non-cutting shaping process, for example, a deep-drawing process.

Also conceivable is the use of a stator, which is produced in a non-cutting shaping process from a sheet-metal blank. By forming the stator as a thin-walled, shaped sheet-metal part, in the circumferential direction of the stator, radial profiling is constructed. In this case, the stator is made from radially outer circumferential walls and radially inner circumferential walls and side walls, which each connect an inner circumferential wall to an outer circumferential wall. This profiling can be used to transfer the torque transmitted from the drive wheel to the housing to the stator. For this purpose, the inner diameter of the circumferential surface of the pot-shaped section or sections is adapted to the outer diameter of the outer circumferential walls. Consequently, the stator can be held in the housing, wherein the stator is simultaneously centered relative to the housing. Between the outer circumferential walls of the stator, on the pot-shaped section/s of the housing housing/s there are formations, which are constructed so that they contact corresponding side walls. In this way, in the circumferential direction a positive-fit connection is realized, by which the torque can be transferred from the housing to the stator. By transmitting the torque via surfaces in contact in the circumferential direction and the enlarged contact surface area, the stator can be made thinner and thus more lightweight and more cost-effective. In addition, this type of connection can be produced significantly more reliably.

In addition, the formations in the housing can be used for the engagement of the drive wheel. By forming an inner casing surface of the drive wheel complementary to the outer casing surface of the housing, at this point a positive-fit connection in the circumferential direction can also be produced.

Likewise, the use of this positive-fit connection between the housing and a solid stator, for example, made from sintered metal, is also conceivable. Advantageously, for this purpose, the profiling of the outer circumferential surface of the stator is already taken into account in the shaping tool. Therefore, no additional costs are generated, while the quality of the stator-housing connection can be significantly improved.

Naturally, the invention is also conceivable in chain-driven or gear-driven devices.

In one advantageous refinement of the invention, a locking device is provided, wherein a locking pin engages in a connecting element formed on a sealing disk and wherein the sealing disk is made from steel that can be hardened.

BRIEF DESCRIPTION OF THE DRAWINGS

Additional features of the invention emerge from the following description and from the drawings, in which embodiments of the invention are shown simplified. Shown are.

DETAILED DESCRIPTION OF THE PREFERRED EMBODIMENTS

Figure 1:
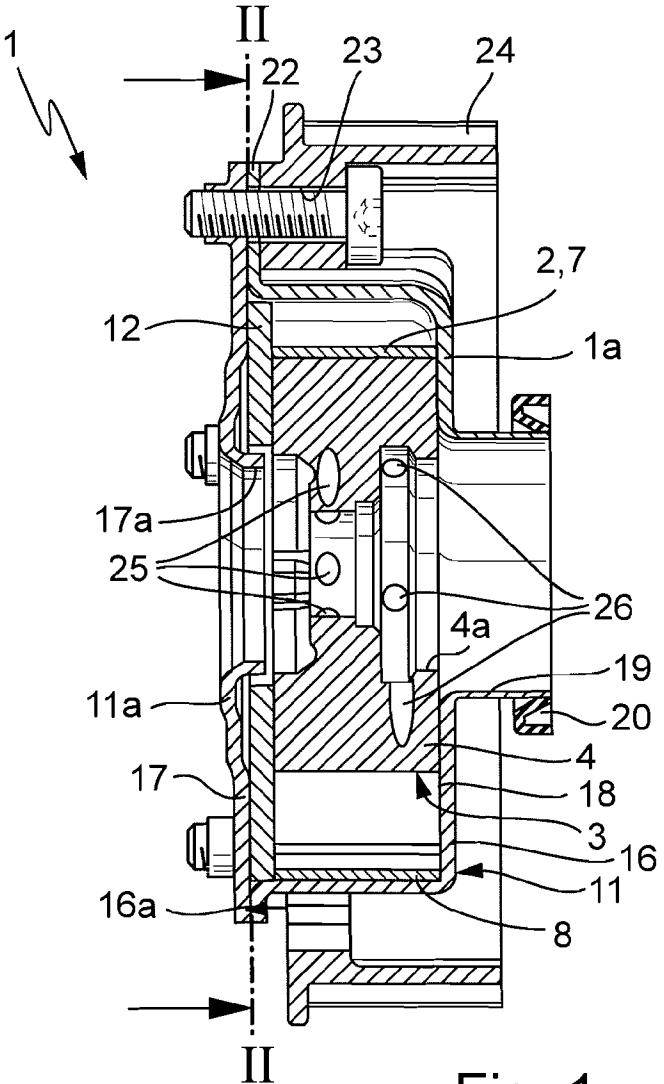
FIG. 1 a longitudinal section view through a device according to the invention, FIG. 2 a plan view of the device according to the invention from FIG. 1 along the line II-II, FIG. 3 a perspective view of a housing element of the device according to the invention from FIG. 1, FIG. 4 a plan view of the other device according to the invention analogous to that from FIG. 1, along the line II-II.
Figure 1A:
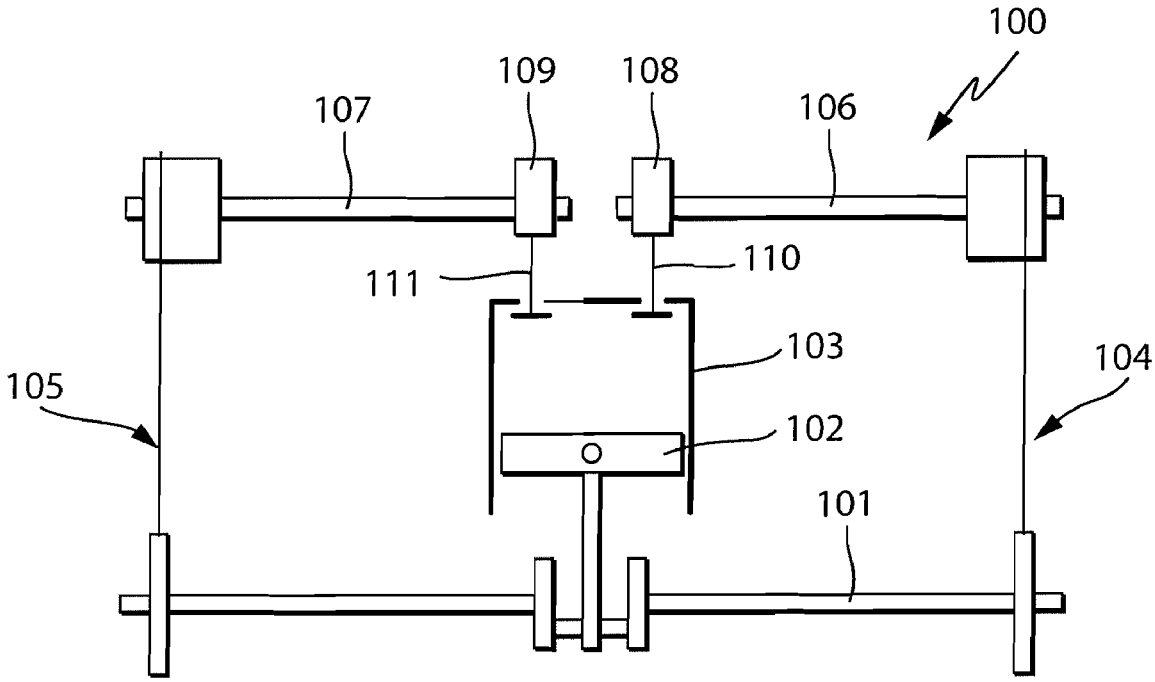
FIG. 1*a* a simplified schematic view of an internal combustion engine.

In FIG. 1*a*, an internal combustion engine 100 is sketched, wherein a piston 102 sitting on a crankshaft 101 is shown in a cylinder 103. The crankshaft 101 connects in the shown embodiment via a traction mechanism drive 104 or 105 with an intake camshaft 106 or an exhaust camshaft 107, wherein a first and a second device 1 can provide for a relative rotation between the crankshaft 101 and camshafts 106, 107. Cams 108, 109 of the camshafts 106, 107 actuate an intake gas-exchange valve 110 or the exhaust gas-exchange valve 111. Likewise, it can be provided to equip only one of the camshafts 106, 107 with a device 1 or to provide only one camshaft 106, 107, which is provided with a device 1.

Figure 2:
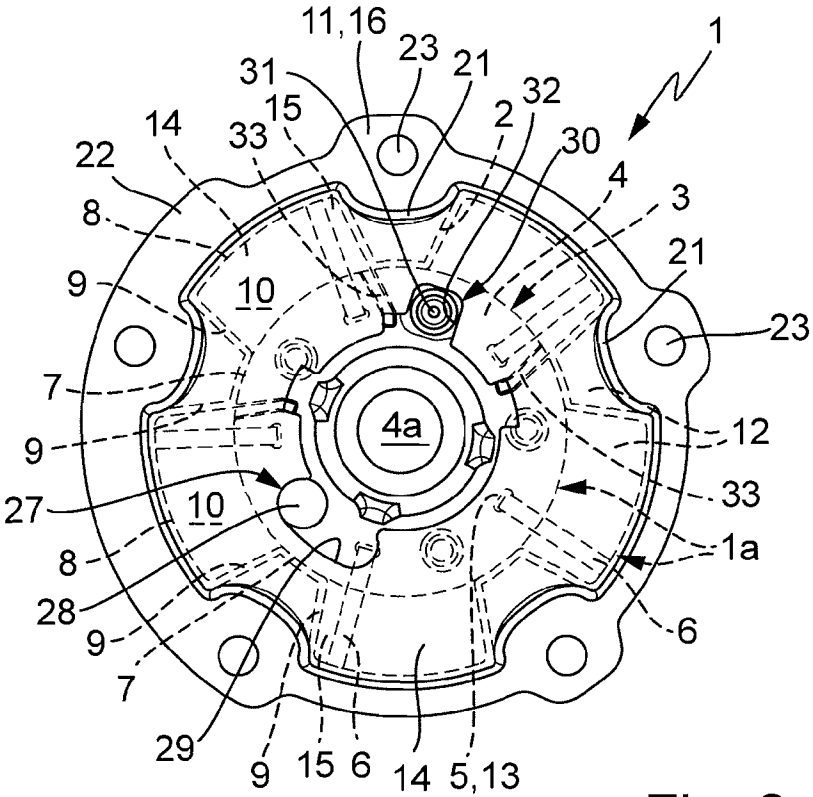

FIGS. 1 and 2 show a first embodiment of a device 1 for variable adjustment of the control times of gas-exchange valves of an internal combustion engine. Below, the invention will be explained with reference to a belt-driven device 1. Also conceivable are chain-driven or gear-driven devices. The special feature of the belt-driven devices lies in their pressurized medium-tight encapsulation, which is not necessary in the other embodiments. A control device 1*a* is comprised essentially from a stator 2 and a driven element 3 arranged concentric to the stator. In FIG. 2, a plan view of a sealing disk 12 is shown, wherein components lying behind this disk are indicated by dashed lines.

The driven element 3 is made from a wheel hub 4, on whose outer periphery axial blade grooves 5 are formed, and five blades 6, which are arranged in the blade grooves 5, extend radially outwardly. Furthermore, the driven element 3 is provided with a stepped central borehole 4*a*, in which a not-shown camshaft engages, in FIG. 1 from the right, in the assembled state of the device 1. In the assembled state of the device 1, this is locked in rotation with the camshaft, for example, by a non-positive fit, friction fit, positive fit, or press fit connection or by fastening means.

The stator 2 is constructed as a thin-walled sheet-metal part, wherein this is made from inner circumferential walls 7 and outer circumferential walls 8, which are connected to each other via side walls 9. The inner and outer circumferential walls 7, 8 extend essentially in the circumferential direction, while the side walls 9 extend essentially in the radial direction. The stator 2 is produced in one part by a non-cutting shaping process from a sheet-metal blank. Here, it can be provided to produce the stator 2 by a deep-drawing method, for example, from a steel plate, without cutting. Through the use of the inner circumferential walls 7, which contact a cylindrical circumferential wall of the driven element 3, the stator 2 is supported so that it can rotate on the driven element 3. Starting from the inner circumferential walls 7, the side walls 9 extend essentially in the radial direction outward and transition into the outer circumferential walls 8. Through this construction, several pressure spaces 10 are formed, in the shown embodiment five, which, as described below, are closed in a pressure-tight manner in the axial direction by a housing 11 or by a sealing disk 12.

The blades 6 are arranged on the outer casing surface of the driven element 3 such that a blade 6 extends into a pressure space 10. Here, the blades 6 contact the outer circumferential walls 8 of the stator 2 in the radial direction. For this purpose, spring elements 13, which force the blades 6 radially outwardly, are arranged in the blade grooves 5. The width of the blades 6 is constructed so that the blades 6 contact the housing 11 or the sealing disk 12 in the axial direction. In this way, it is achieved that each blade 6 divides a pressure space 10 into two pressure chambers 14, 15 acting against each other.

The stator 2 and the driven element 3 are arranged within the housing 11, which is constructed so that it encapsulates these components in an oil-tight manner. The housing 11 is made from an essentially pot-shaped first housing element 16 and a disk-shaped second housing element 17. The connection point of the housing elements 16, 17 can be sealed by a not-shown sealing means or by a sealing joining method. In the shown embodiment, a weld connection 16*a* in the circumferential direction is provided. The first housing element 16 is arranged on the camshaft-facing side of the device 1. A flat section perpendicular to the axial direction of the device 1 in a pot-shaped section of the first housing element 16, called base 18 below, is put through symmetric to the rotational axis of the first housing element 16, wherein a cylindrical section 19 extending in the axial direction is formed. The section 19 is used, first, for holding the not-shown camshaft or a pressurized medium distributor. Second, in the case of a belt-driven device 1, the outer casing surface of the cylindrical section 19 can be used as a seat of a radial shaft seal 20, which seals the device 1 relative to a not-shown cylinder head.

The inner diameter of the essentially cylindrical casing surface of the pot-shaped section of the first housing element 16 is adapted to the outer diameter of the outer circumferential walls 8 of the stator 2. This guarantees a centered holding of the stator 2 in the first housing element 16. In addition, the essentially cylindrical casing surface of the first housing element 16 is provided with formations 21, which extend radially inward between adjacent outer circumferential walls 8 of the stator 2. The formations 21 are constructed such that these contact the corresponding two side walls 9 of the stator 2 in the circumferential direction. In this way, a positive-fit connection is produced in the circumferential direction between the stator 2 and the housing 11, whereby the two components are locked with each other in rotation. Here it can be provided that the formations 21 extend up to the inner circumferential walls 7 of the stator 2 or that the formations 21 engage only partially in this hollow space.

In addition, a radially extending collar 22, in which boreholes 23 are formed, is constructed on the end of the first housing element 16 facing away from the camshaft.

The second housing element 17 is arranged coaxial to the first housing element 16, wherein the outer circumferential surface of the second housing element 17 is constructed complementary to the collar 22 of the first housing element 16. Through the use of connection means 24, screws in the shown embodiment, the two housing elements 16, 17 and a drive wheel 24 constructed as a belt wheel are locked in rotation with each other. Alternatively, non-positive or positive-fit connection methods could also be provided. In addition, the inner circumferential surface of the drive wheel 24 could be constructed complementary to the outer circumferential surface of the first housing element 16, whereby the drive wheel 24 engages in the formations 21 of the first housing element 16 and thus the two components are connected with a positive fit in the circumferential direction. The introduction of the torque transmitted from the crankshaft to the drive wheel 24 can now be transmitted to the stator via the positive-fit connections between the drive wheel 24 and the formations 21 of the first housing element 16 and furthermore via the positive-fit connections between the formations 21 and the stator 2. This positive-fit connection of the components in the circumferential direction replaces the friction-fit connection described in the state of the art between the bases of the housing elements and an axial side surface of the stator 2. Thus, the transmitted forces act in the direction of the connection between the components and over a significantly larger surface, whereby the forces can be transmitted reliably. The transmitted force is distributed onto a larger connection surface, whereby the stator 2 can have a thin-walled construction. In this way, in addition to the functional reliability of the torque transmission, the weight of the device 1 and thus its moment of inertia and also the costs will be reduced.

The second housing element 17 can be provided, as shown in FIG. 1, with a central opening 17*a*. This opening 17*a* is used for an embodiment of the device 1, in which the driven element 3 is fixed by a central screw to the camshaft, as an engagement opening for a tool for tightening the central screw. In this case, the opening 17*a* can be closed in an oil-tight manner by a not-shown cover after the assembly of the device 1 on the camshaft.

Also conceivable are embodiments of the device 1, in which the second housing element 17 is constructed without an opening 17*a*.

Figure 3:
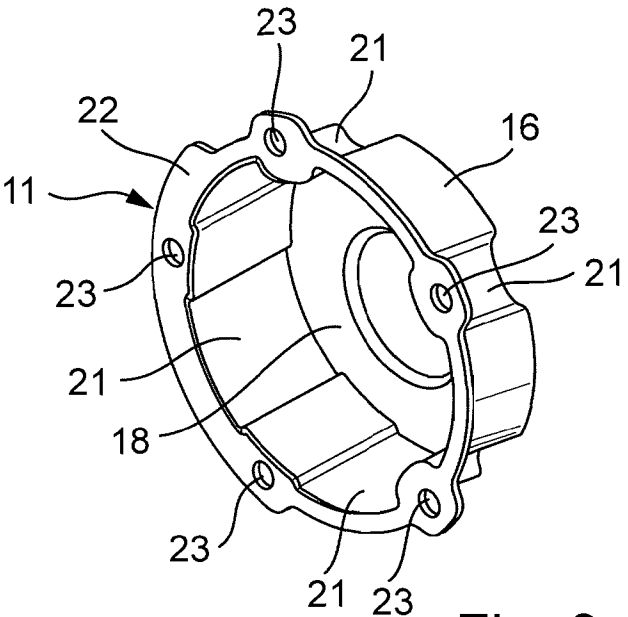

On the second housing element 17, molded elements 11*a* are formed, which, first, cause a reinforcement of the component and, second, increase the surface area of the housing 11 and thus contribute to improved cooling. Especially advantageous is a construction of the molded elements 11*a* as cooling ribs. In FIG. 3, a perspective view of the first housing element 16 is shown. The formations 21, which engage inwardly in the radial direction into the hollow spaces of the stator 2, can be seen easily. The formations 21 also allow the engagement of the drive wheel 24 on the outer casing surface, wherein advantageously the inner casing surface of the drive wheel 24 is adapted to the outer casing surface of the first housing element 16.

As is to be seen in FIG. 1, the pressure spaces 10 are closed pressure-tight in the axial direction on the camshaft-facing side of the device 1 by the base 18 of the first housing element 16. For this purpose, the base 18 of the first housing element 16 has a flat construction and is arranged such that it connects in the axial direction directly to the driven element 3 or the stator 2. On the side of the device 1 facing away from the camshaft, there is a sealing disk 12 between the second housing element 17 and the stator 2 or the driven element 3. The outer periphery of the sealing disk 12 is adapted to the inner contours of the first housing element 16, whereby it is locked in rotation with the housing 11 and thus with the stator 2. This contacts both the driven element 3 and also the stator 2, at least in the region of the pressure spaces, and is pressed by the second housing element 17 against the stator 2, whereby the pressure spaces 10 are closed pressure-tight in this axial direction. Alternatively, it is also conceivable to eliminate this sealing disk 12 and to implement the axial sealing of the pressure spaces 10 by the second housing element 17. For this purpose, this second housing element 17 also must have a flat construction.

Therefore, because the base 18 of the first housing element 16 is used as a sealing surface for the pressure spaces 10 in the axial direction, a second sealing disk can be eliminated, whereby the number of components and thus the assembly expense and the costs of the device 1 can be reduced. These advantages could be increased in that the sealing disk 12 is also eliminated and the sealing of the pressure spaces is also implemented in this axial direction by the second housing element 17.

The device 1 is further provided with two groups of pressurized medium lines 25, 26, which extend outward starting from the central borehole 4*a* of the driven element 3 in the radial direction. The first pressurized medium lines 25 here open into the first pressure chambers 14, while the second pressurized medium lines 26 open into the second pressure chambers 15. Through the use of a pressurized medium distributor or alternatively a control valve arranged in the central borehole 4*a* of the driven element 3, pressurized medium can be selectively fed or led away from the first or the second pressure chambers 14, 15 via the pressurized medium lines 25, 26. Thus, between the first and second pressure chambers 14, 15 a pressure gradient can be established. Whereby the blades 6 are forced in the circumferential direction and thus the relative phase position of the driven element 3 relative to the stator 2 can be selectively adjusted variably or held. By adjusting the phase position between the driven element 3, which is locked in rotation with the camshaft and the stator 2, which is in driven connection with the crankshaft, the phase position between the crankshaft and camshaft can be selectively influenced and thus the control times of the gas-exchange valves relative to the position of the crankshaft can be influenced.

In addition, in FIG. 2, a rotational angle limiting device 27 is shown, which is realized by a pin 28 locked in rotation with the driven element 3 and a recess 29 constructed on the sealing disk 12. The pin 28 engages in the recess 29, wherein the recess 29 extends in the circumferential direction, such that the pin 28 comes to lie in both extreme positions of the driven element 3 relative to the stator against an essentially radial wall of the recess 29. In this way it is prevented that the blades 6 extend into the transition region between the outer circumferential walls 8 and the side walls 9. Thus, it is prevented that the blades 6 are fixed at the radii constructed there.

For an insufficient supply of pressurized medium to the device 1, for example, during the start-up phase of the internal combustion engine or while idling, the driven element 3 is moved in an uncontrolled way relative to the stator 2 due to the changing and towing moments, which the camshaft exerts on this driven element. In a first phase, the towing moments of the camshaft force the driven element 3 relative to the stator 2 in a circumferential direction, which lies opposite the rotational direction of the stator 2, until this movement is stopped by the rotational angle limiting device 27. Below, the changing moments, which the camshaft exerts on the driven element 3, lead to a back and forth motion of the driven element 3 and thus of the blade 6 in the pressure spaces 10 until at least one of the pressure chambers 14, 15 is filled completely with pressurized medium. This leads to higher wear and to the development of noise in the device 1. Furthermore, in this operating phase, the phase position between the driven element 3 and the stator 2 oscillates at a high amplitude, which leads to noisy operation of the internal combustion engine.

To prevent this, in the device 1 a locking device 30 is provided. This is comprised of a locking pin 31, which is arranged in a recess of the driven element 3 and which is forced in the direction of the sealing disk 12 by a spring. On the sealing disk 12, a connecting element 32 is formed, in which the locking pin 31 is forced into a maximum advanced position or a maximum retarded position of the driven element 3 relative to the stator 2. In this case, the locking pin 31 contacts the radial limiting walls of the connecting element 32, wherein it simultaneously extends into the receptacle formed on the driven element 3. In this way, a positive-fit, mechanical connection is produced between the driven element 3 and the stator 2 in a relative phase position, which corresponds to an optimum position for the starting and/or the idling of the internal combustion engine. In addition to the locking of the driven element 3 relative to the stator 2 in one of the maximum end positions, it can also be provided to lock both components relative to each other in a middle position. Advantageously, the sealing disk 12 is constructed from steel that can be hardened. The sealing disk 12 is subjected to a hardening method after the shaping, whereby this sealing disk can receive the forces transmitted via the locking pin 31 in a functionally reliable way. This leads to an increased service life of the device 1.

Furthermore, means are provided, in order to force the locking pin 31 back into the receptacle when the device 1 is supplied with sufficient pressurized medium and thus to cancel the locking. In the shown embodiment, it is provided to pressurize the connecting element 32 with pressurized medium via pressurized medium channels 33. The pressurized medium channels 33 are constructed as grooves formed in the side surface of the driven element 3. These grooves extend from at least one of the pressure chambers 14, 15 up to the connecting element 32.

The pressurized medium led into the connecting element 32 forces the locking pin 31 against the force of the spring back into the receptacle, whereby the fixed phase reference between the driven element 3 and stator 2 is canceled.

Here, it is provided that the pressurized medium channels 33 communicate with the connecting element 32 only in a defined small angular interval of the phase position between the stator 2 and the driven element 3.

The housing 11 is advantageously constructed as a sheet-metal housing, wherein the two housing elements 16, 17 are each produced from a sheet-metal blank by a non-cutting shaping process. Here, for example, techniques such as deep-drawing methods are considered. By forming the housing 11 from a steel sheet-metal blank, a reliable sealing of the device 1 is guaranteed, whereby the device 1 can be used as a belt-driven camshaft adjuster. Such camshaft adjusters are typically arranged outside of the cylinder head, whereby a secure sealing of the device 1 is required. Leakage oil is collected by the formation of the housing 11 as a molded sheet-metal part within the device 1 and can be fed back into the cylinder head via channels formed on the cylindrical section 19. Alternatively, between the section 19 and the camshaft, an annular gap can be formed, in order to lead leakage oil back into the cylinder head. The first housing element 16 is advantageously sealed relative to the cylinder head by a radial shaft seal 20 arranged on the section 19.

Through the encapsulation of the stator 2 and the driven element 3 within the housing 11, cost-intensive post-treatment for sealing the driven element 3 normally formed as a porous sintered component can be eliminated. Any small leakage through the sintered material or at the sealing points is kept within the device 1 by the housing 11 and can be fed back into the cylinder head.

In the embodiment, in which the pressure spaces 10 are closed pressure-tight by a sealing disk 12 on the side of the device 1 facing away from the camshaft, this sealing disk 12 can be used simultaneously as a compensating disk in order to compensate any tolerances between the two housing elements 16, 17.

Figure 4:
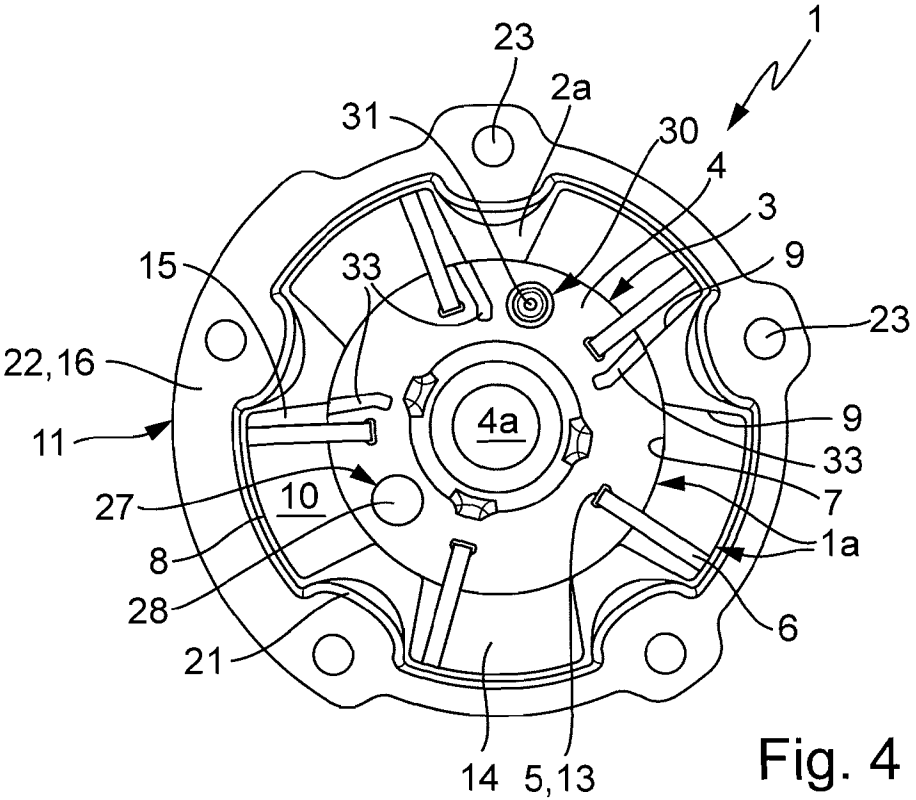

FIG. 4 shows another embodiment of a device 1 according to the invention. In this view, the sealing disk 12 is removed. This embodiment is essentially identical to the first embodiment, which is why identical components are provided with identical reference numbers. In contrast to the first embodiment, here the stator 2*a* is not constructed as a thin-walled, shaped sheet-metal part, but instead as a solid component. This component can involve, for example, a stator 2*a* made from a sintered material. In this embodiment, the housing 11 fulfills the same functions as in the first embodiment (torque transmission, sealing of the pressure spaces 10), whereby the same advantages are achieved. The formations 21 engage in indentations 21*a* formed on the stator 2*a*. These indentations can be constructed cost-neutral on the sintered component, such that these are already taken into account in the shaping tool.

REFERENCE SYMBOLS

1 Device
1*a* Control device
2 Stator
2*a* Stator
3 Driven element
4 Wheel hub
4*a* Central borehole
5 Blade groove
6 Blade
7 Inner circumferential wall
8 Outer circumferential wall
9 Side wall
10 Pressure space
11 Housing
11*a* Molded element
12 Sealing disk
13 Spring element
14 First pressure chamber
15 Second pressure chamber
16 First housing element
16*a* Weld connection
17 Second housing element
17*a* Opening
18 Base
19 Section
20 Radial shaft seal
21 Formations
22 Collar
23 Boreholes
24 Drive wheel
25 First pressurized medium line
26 Second pressurized medium line
27 Rotational angle limiting device
28 Pin
29 Recess
30 Locking device
31 Locking pin
32 Connecting element
33 Pressurized medium channel
100 Internal combustion engine
101 Crankshaft
102 Piston
103 Cylinder
104 Traction mechanism drive
105 Traction mechanism drive
106 Inlet camshaft
107 Outlet camshaft
108 Cam
109 Cam
110 Intake gas-exchange valve
111 Exhaust gas-exchange valve

The invention claimed is:

1. Device for the variable adjustment of the control times of gas-exchange valves of an internal combustion engine, comprising a stator and a driven element arranged coaxial to the stator, wherein the stator and the driven element are mounted so that they can rotate relative to each other and at least one pressure space bounded by the stator and the driven element at least in a radial direction and in a circumferential direction, a housing, which is constructed separate from the stator and the driven element and which at least partially encapsulates the stator and the driven element, the housing includes a pot-shaped first housing element with at least one flat section of the first housing element that extends perpendicular to the axial direction of the device to act as a sealing surface for the pressure space and bounds the pressure space in a sealing manner in a first axial direction, and an outer circumferential wall that entirely surrounds a radial periphery of the stator and the driven element for an entire axial depth thereof, and a second housing element that defines and seals the pressure space in a second axial direction.

2. Device according to claim 1, wherein the stator is in drive connection with the housing via a positive-fit connection formed by inter-engaging inwardly directed projections of the circumferential wall of the first housing element and inwardly directed recesses in the stator.

3. Device according to claim 1, wherein the stator is a non-cutting shaped sheet-metal part having an inner circumferential thin-walled sheet-metal wall and an outer circumferential thin-walled sheet-metal wall which are connected together by thin-walled sheet-metal side walls, the inner circumferential thin-walled sheet-metal wall contacting the driven element.

4. Device according to claim 3, wherein the stator is a deep drawn part.

5. Device according to claim 1, wherein at least one of the housing elements is a non-cutting, shaped sheet-metal part.

6. Device according to claim 5, wherein at least one of the housing elements is a deep drawn part.

7. Device according to claim 1, wherein the housing prevents a discharge of pressurized medium from the device.

8. Device according to claim 1, wherein the two housing elements are connected to each other by a weld connection.

9. Device according to claim 1, wherein a cylindrical section extending in an axial direction is constructed on the housing for sealing the device against a radial shaft sealing ring.

10. Device according to claim 9, wherein a camshaft engages in the section and a gap is formed between an inner diameter of the section and the camshaft.

11. Device according to claim 1, wherein molded elements for increasing a surface area are formed on at least one of the housing elements.

12. Device according to claim 1, wherein a locking device is provided, having a locking pin that engages in a connecting element formed on a sealing disk and wherein the sealing disk is made from steel that can be hardened.

13. Device for the variable adjustment of the control times of gas-exchange valves of an internal combustion engine, comprising a driven element driving a camshaft, a stator driven by a crankshaft, wherein the driven element and the stator are mounted so that they can rotate relative to each other, and with a housing, which is constructed separate from the stator and the driven element, the housing at least partially surrounds the driven element and the stator, wherein at least one pressure space is defined by the stator, the driven element, and the housing, a base of a pot-shaped section of the housing acts at least in one axial direction as a sealing surface for the pressure space, the stator is a non-cutting shaved sheet-metal part having an inner circumferential thin-walled sheet-metal wall and an outer circumferential thin-walled sheet-metal wall which are connected together by thin-walled sheet-metal side walls, the inner circumferential thin-walled sheet-metal wall contacting the driven element.

14. Device according to claim 13, wherein the stator is a deep drawn part.

15. Device according to claim 13, wherein the housing prevents a discharge of pressurized medium from the device.

16. Device according to claim 13, wherein a cylindrical section extending in an axial direction is formed on the housing for sealing the device against a radial shaft sealing ring.

17. Device according to claim 16, wherein a camshaft engages in the section and a gap is formed between an inner diameter of the section and the camshaft.

18. Device according to claim 13, wherein molded elements for increasing the surface area are formed on the housing.

19. Device according to claim 13, wherein a locking device is provided, having a locking pin that engages in a connecting link formed on a sealing disk and the sealing disk is made from steel that can be hardened.

* * * * *